United States Patent [19]

Yamat et al.

[11] Patent Number: 4,591,679

[45] Date of Patent: May 27, 1986

[54] LOADBREAK SWITCH ACTUATOR

[75] Inventors: Miguel B. Yamat, Franklin; Edwin A. Link, Waukesha, both of Wis.

[73] Assignee: RTE Corporation, Waukesha, Wis.

[21] Appl. No.: 590,392

[22] Filed: Mar. 16, 1984

[51] Int. Cl.[4] ..... H01H 33/66

[52] U.S. Cl. ..... 200/144 B; 200/67 R; 200/153 G

[58] Field of Search ..... 200/144 B, 153 G, 67 R, 200/67 A

[56] References Cited

U.S. PATENT DOCUMENTS

| | | | |
|---|---|---|---|
| 3,267,247 | 8/1966 | Ross | 200/144 B |
| 3,280,282 | 10/1966 | Rodeseike et al. | 200/144 B |
| 3,471,669 | 10/1969 | Curtis | 200/144 B |
| 3,526,735 | 9/1970 | Date | 200/144 B |
| 4,484,046 | 11/1984 | Neuhouser | 200/144 B |

*Primary Examiner*—Robert S. Macon
*Attorney, Agent, or Firm*—Ronald E. Barry

[57] ABSTRACT

A manually actuable load break switch actuated having a base mounted on one end of a vacuum actuated switch, an operating lever pivotally mounted on the base and operatively connected to open and close the vacuum switch, a toggle mechanism connected to the end of the operating lever, the toggle member including a compression spring for biasing the operating lever to the closed position, a manually actuated handle pivotally mounted on said base for tripping the toggle mechanism by movement from one side of the toggle mechanism to the other, spring means operable connecting the handle to the toggle mechanism, and a lock pin biased into engagement with the end of the lever to lock the lever in the switch open position.

21 Claims, 5 Drawing Figures

LOADBREAK SWITCH ACTUATOR

BACKGROUND OF THE INVENTION

Manually actuated loadbreak switches require considerable force to actuate the operating mechanism in order to open and close the switch. In the case of vacuum interrupters, overtravel and rebound of the moving contact can affect or reduce the life of the interrupter. On current interruption, fast action is required to prevent or minimize restrikes. On fault close, positive movement is required to prevent blow-off or welding of the contact.

SUMMARY OF THE INVENTION

The actuating mechanism for the loadbreak switch according to the present invention, provide a mechanical advantage both in opening and closing of the switch which assures fast action and positive closing. On opening, the operating lever is positively locked in the open position to eliminate any rebound as a result of the sudden stop of the fast moving mechanism of the switch. On closing, a delay is provided in order to prevent premature closing and to increase the operating force of the actuator to close the lever, thus assuring a positive closing action and no rebound. In the case of vacuum switches, multiple stops are provided to prevent overtravel and protect the bellows.

IN THE DRAWINGS

DESCRIPTION OF THE INVENTION

Figure 1:
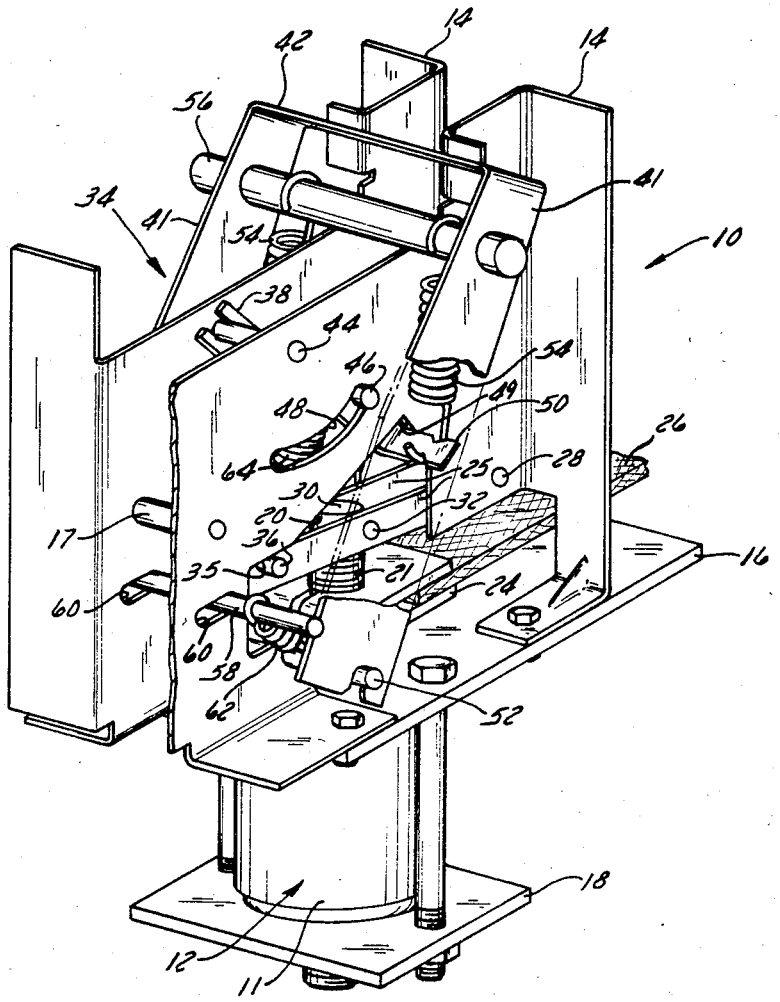
FIG. 1 is a perspective view of the actuating mechanism shown mounted on a loadbreak vacuum switch.

As seen in the drawings, the actuating mechanism 10 according to the present invention, is shown mounted on the end of a loadbreak vacuum switch 12. Although the invention is described in connection with a loadbreak vacuum switch, it should be apparent that it could be used with any loadbreak switch where a large mechanical advantage is required. The conventional vacuum switch includes a sealed housing or bottle 11 mounted on end plates 16 and 18 and having a fixed contact 13 at one end and a movable contact 22. The contact 22 is mounted on an actuator 21 that is supported by a bellows 23 for movement into and out of engagement with the fixed contact 13.

The actuating mechanism includes a housing formed by means of two side plates 14 which are mounted on the end plate 16 for the vacuum switch 12 and held in a spaced relation by spacers 17. Each of the side plates 14 includes a cut-out section 20 located on either side of the actuator 21 for the moving contact 22 of the vacuum switch. Two arcuate slots 48 and 60 are provided in the side plates. The moving contact 22 is connected to the power line 26 by means of a terminator 24 mounted on the actuator 21.

The vacuum switch 12 is opened and closed by means of a pair of actuating levers 25 pivotally mounted in a parallel spaced relation on a pin 28 provided between the side plates 14. The levers 25 are connected to the actuator 21 by means of a stud 30 which is screwed into the end of the actuator 21 and connected to the levers 25 by a pin 32 at the center of the levers 25. The levers 25 are pivoted between open and closed contact positions by means of a toggle mechanism 34 connected to the free end of the levers 25 by means of a pin 36. The pivotal motion of the levers 25 is limited by means of the edge 35 of cut-out section 20 in the side plates 14 which lies in the path of motion of the ends of pin 36.

In this regard, the toggle mechanism 34 includes a first link 38, a connecting link 40 and an actuating member in the form of a yoke 42. The first link 38 is pivotally mounted on a fixed pivot pin 44 provided between the side plates 14. The first link 38 is limited in its pivotal movement by means of a pin 46 which is aligned with the arcuate slots 48 in the side plates 14. A pair of ears 50 are provided at the end of the first link 38. The pivotal motion of the link 38 is limited by the edges 19 of the cut-out section 20 in side plate 14 which lies in the path of motion of the ears 50.

The connecting link 40 is pivotally connected to the first link 38 by means of the pin 46 and to the end of the levers 25 by means of the pin 36. The link 40 is connected to the pin 36 by means of a lost motion connection in the form of a slot 51. A compression spring 64 is mounted on its link 40 between pins 36 and 46.

The actuating member 42 includes a pair of legs 41 which are pivotally mounted on a fixed pivot pin 52. The member 42 is connected to the first link 38 by means of a tension or extension spring 54 connected at one end to the ears 50 on the link 38 and at the other end to an operating bar 56 mounted on the legs 41. It should be noted that the ears 50 are spaced a distance away from the pivot pin 46 to provide a mechanical advantage for in opening and closing the links 38 and 40.

The toggle mechanism 34 opens and closes the vacuum switch by pivoting the actuating yoke 42 about pin 52 to transfer the bias force of spring 54 acting on the first link 38 from one side of a line 39 between pin 44 and ears 50 to the other side of line 39. In this regard, on movement of the yoke 42 clockwise to the position shown in FIG. 2, the first link 38 will pivot counterclockwise about the pin 44. The bias force of the compression 64 will accelerate the movement of the link 38. The pivotal movement of the link 38 is limited by the engagement of pin 46 with the end of the arcuate slot 48. The pin 46 on link 38 will pull the connecting link 40 away from the pin 36 until the pin 36 engages the end of slot 51 in link 40 to pivot the levers 25 about pin 28. The upward movement of levers 25 will open the vacuum switch 12.

Figure 2:
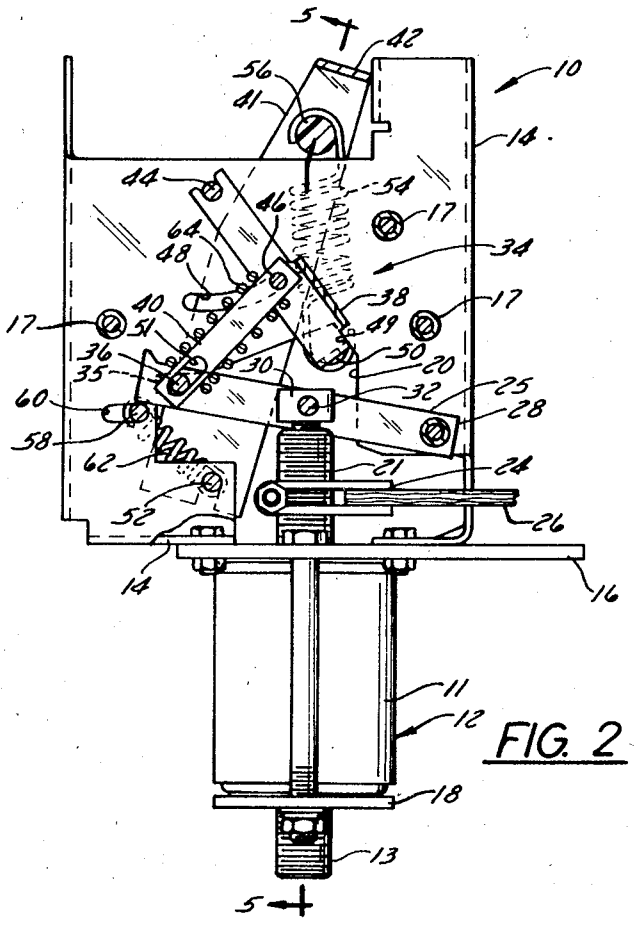
FIG. 2 is a side view of the actuating mechanism shown in the open position.
Figure 3:
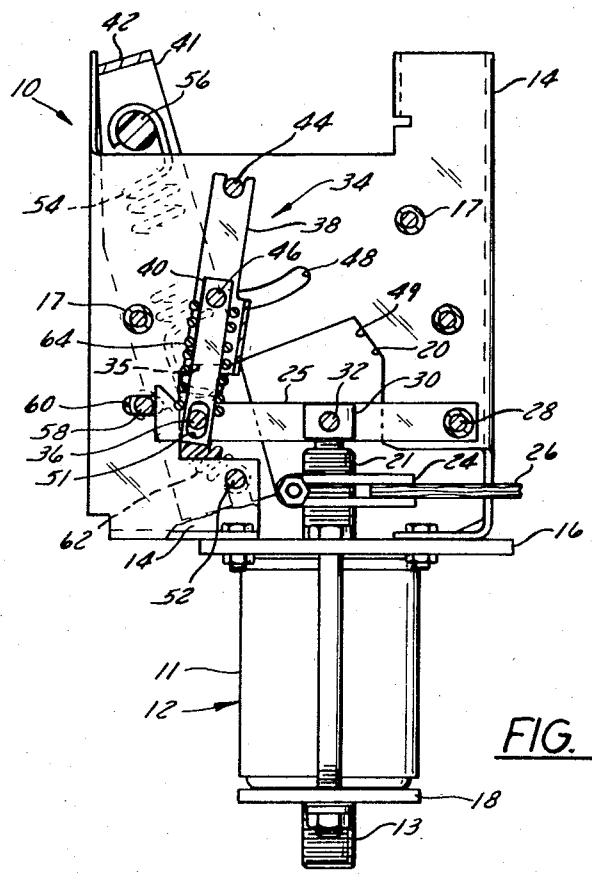
FIG. 3 is a side view of the actuating mechanism shown in the closed position.
Figure 5:
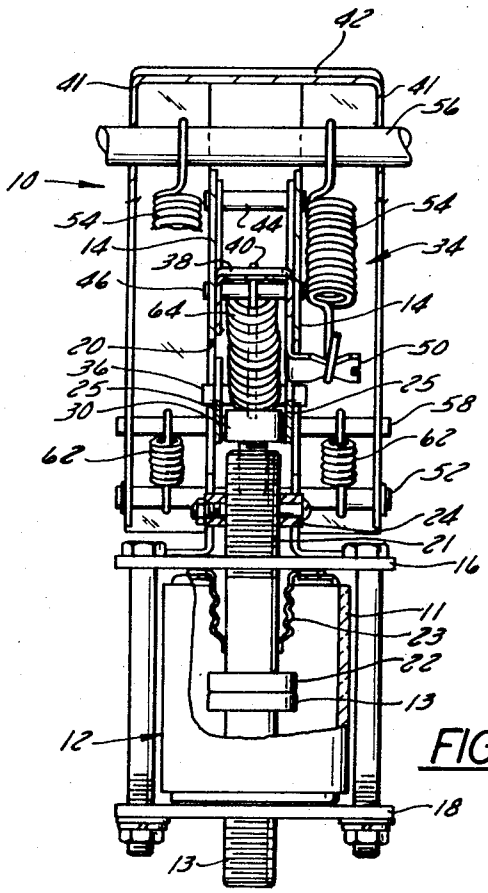
FIG. 5 is a section view taken on line 5—5 of FIG. 2.

On movement of the yoke 42 counterclockwise from position shown in FIG. 2, the first link 38 will pivot clockwise about pin 44 until pin 46 reaches the other end of slot 48. The pin 46 will compress the spring 64 on link 40 toward pin 36 after contact 22 engages contact 13. The downward movement of levers 25 will close the vacuum switch 12.

In accordance with one aspect of the invention, means are provided to positively lock the levers 25 in the upper or open contact position. Such means is in the form of a rod 58 which is positioned in arcuate slots 60 provided in the side plates 14. The rod 58 is biased against the end of the levers 25 by means of a tension spring 62 connected to the rod 58 at one end and to the pivot pin 52 at the other end. Once the levers 25 are moved far enough to clear the rod 58, the rod will be pulled by the springs 62 to the end of the arcuate slot 60 underneath the levers 25. The upward movement of the levers 25 is limited by the engagement of pin 36 with the edge 35 of the cut-out 20 in the side plates 14.

In order to close the vacuum switch 12, the rod 58 must be moved away from the levers 25. This is accomplished by means of the actuating yoke 42 which is normally pivoted about pin 52 to move the spring 54 to the other side of the line 39. The closing motion of yoke 42 will move legs 41 into engagement with the rod 58 pushing the rod 58 through slots 60 until the rod 58 clears the end of levers 25. The levers 25 will then be free to pivot about pin 28.

Means are provided on link 40 to bias the levers 25 to the switch close position. Such means is in the form of the compression spring 64 mounted on link 40 between pins 36 and 46. The lost motion connection between link 40 and pin 36 provided by slot 51 in link 40 allows the spring 64 to be compressed between pins 36 and 46. This compressive force will provide a positive bias force on closing of the contacts 22 in switch 12 and thereby preventing rebound of the contacts 22.

Figure 4:
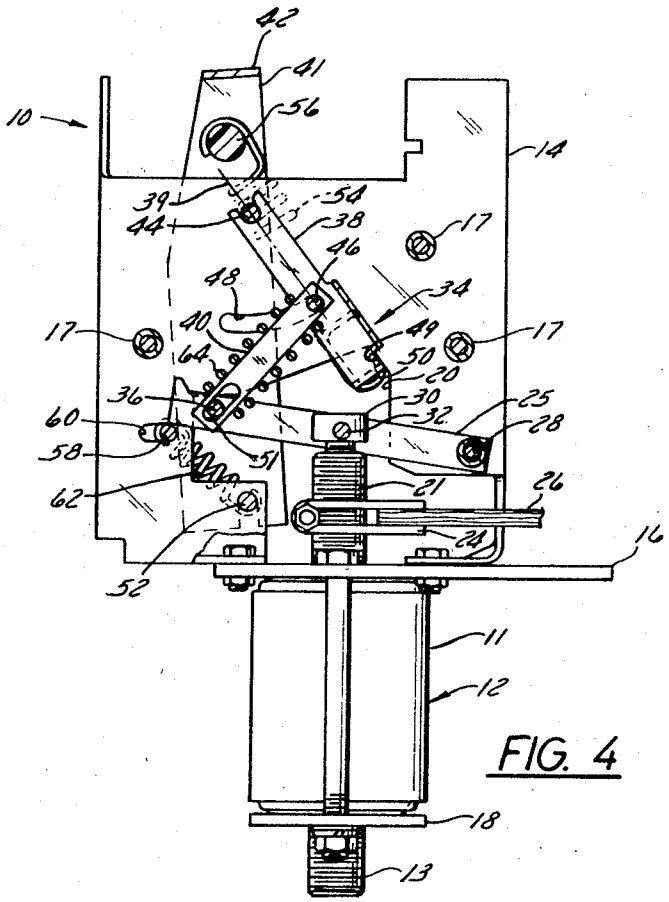
FIG. 4 is a side view of the actuating mechanism shown in an intermediate stage of the closing motion with one side plate removed.

In order to provide sufficient force to return the toggle mechanism 34 to the switch closed position, the bias force of spring 54 must be sufficient to compress the spring 64 as the links 38 and 40 are pulled to the switch close position. This is accomplished by delaying the closing motion of the links 38 and 40 until the yoke 42 has moved beyond the normal toggle point of pin 44 i.e. line 39. This can be seen in FIG. 4 where the yoke 42 is shown approaching the end of its return motion with the tension spring 54 extended beyond its normal limits. This delay is provided by the rod 58 which prevents pivotal movement of levers 25. Once the rod 58 clears the levers 25, the bias force of spring 54 will be at its maximum which will be sufficient to pull link 38 toward the close position and compress spring 64.

During the closing motion of the toggle mechanism 34, the mechanical advantage on the lever 25 is 2. The mechanical advantage of links 38 and 40 increases as the mechanism approaches the closed position. As the pin 46 passes over center (a line from pin 44 to pin 36) the total mechanical advantage is infinity. This means that the mechanism will remain locked at the closed position independent of springs 54.

It should be noted that the bellows 24 is protected from over travel on switch opening by means of a number of stops provided on the side plate 14. In this regard, the pin 36 on lever 25 is stopped by the edge 35 of cut-out 20, the ears 50 by the edge 49 of cut-out 20 and the pin 46 on reaching the end of slot 64.

The embodiments of the invention in which an exclusive property or privilege is claimed, are defined as follows:

1. A loadbreak switch actuator comprising a pair of plates adapted to be mounted on a switch, a lever pivotally mounted on said plates, means for connecting said lever to the switch, and an overcenter toggle mechanism operatively connected to said lever for opening and closing the switch, said mechanism including a first link pivotally mounted on said plates, a second link pivotally connected to said first link and to said lever, a compression spring mounted on said second link in a position to bias the pivotal connection of said first link to said second link away from the pivotal connection of said second link to said lever, an actuating member pivotally mounted on said plates and spring means connecting said actuating member to said first link, said actuating member being movable from a first position where the bias force of said spring means is on one side of a line between the pivotal connection of the first link to said plates and the pivotal connection of the first link to the second link to a second position where the bias force of said spring is on the opposite side of the line whereby the pivotal connection of the first link with the second link will move from one side of the line to the other side of the line.

2. The loadbreak switch actuator according to claim 1 including means in said plates for limiting the movement of the pivotal connection of the first link with the second link.

3. The actuator according to claim 1 wherein said compression spring is compressed between the pivotal connection of the first link with the second link and the pivotal connection of the second link with the lever when the switch is closed.

4. The actuator according to claim 3 wherein said second link includes a lost motion connection with said lever.

5. The actuator according to claim 1 including means for positively locking said lever in the switch open position.

6. The actuator according to claim 5 wherein said locking means includes a rod mounted in an arcuate slot in said plates and a spring for biasing said rod to a position to prevent said lever from closing said switch.

7. The actuator according to claim 6 wherein said actuating member is positioned to disengaged the pin from the lever on movement of the actuating member to the switch closing position.

8. A load break switch actuator for a vacuum switch, said actuator including a housing, a lever having one end pivotally mounted on said housing, means intermediate the ends of said lever for connecting said lever to said switch, an over center toggle mechanism pivotally connected to said housing and to the other end of said lever for moving said lever between open and closed positions with respect to said switch, an actuating member pivotally connected to said housing, and first spring means connecting said actuating member to said toggle mechanism for tripping said toggle mechanism on pivotal movement of said actuating member from one side of said toggle mechanism to the other, said toggle mechanism including compression spring means for biasing said lever to the closed position.

9. The actuator according to claim 8 wherein said toggle mechanism includes a first link having one end pivotally connected to said housing and a second link having one end pivotally connected to said lever and the other end pivotally connected to said first link intermediate the ends thereof.

10. The actuator according to claim 9 wherein said second link includes last motion means at the pivotal connection of the second link to the lever.

11. The actuator according to claim 10 wherein said compression spring means is positioned between the pivotal connection of said second link to said first link and the pivotal connection of said second link to said lever.

12. The actuator according to claim 8 including pin means for locking said lever in the switch open position.

13. The actuator according to claim 12 wherein said pin means includes a slot in said housing defining a locking position and a switch closed position, a pin in said slot and a spring biasing said pin toward the locking position in said slot.

14. The actuator according to claim 13 wherein said pin is located on the path of motion of said actuating member whereby the actuating member will move the pin to the switch closed position in said slot when the vacuum switch is closed.

15. The actuator according to claim 11 wherein said first spring means is connected to the other end of said first link whereby pivotal movement of said actuating member will transfer the bias force of said first spring means from one side of first link to the other side of said first link.

16. The actuator according to claim 15 including pin means for locking said lever in the switch open position, said pin means being located in the path of motion of said actuating member, whereby said pin means is moved away from the locking position with respect to said lever by the switch closing motion of said actuating member.

17. A manually actuable load break switch actuator for opening and closing a vacuum switch, said actuator comprising plate means adapted to be mounted on the vacuum switch, a lever having one end pivotally connected to said plate means, means connected to said lever intermediate the ends thereof for operatively connecting said lever to the vacuum switch, a toggle mechanism connected to the other end of said lever for moving said lever between open and closed positions with respect to the switch, said toggle mechanism including a first link having one end pivotally connected to said plate means a second link having one end pivotally connected to said other end of said lever, a pivot pink pivotally connecting said other end of said second link to said first link, a manually operable handle pivotally connected to said plate means for movement from one side of the pivotal connection of said first link to said plate means to the other side of said pivotal connection to said plate means.

a tension spring connecting said handle to the other end of said first link, and pin means biased to move to a locking position with respect to said lever when said lever is moved to the switch open position, said pin means being located in the path of motion of said handle whereby the switch closing motion of said handle will move said poin means away from said locking position with respect to said lever to allow said lever to close the switch.

18. The actuator according to claim 17 wherein said toggle mechanism includes a compression spring for biasing said lever to the switch closing position.

19. The actuator according to claim 18 wherein said compression spring is positioned between said pivot pin and the pivotal connection of said second link to said lever.

20. The actuator according to claim 19 wherein said second link includes a lost motion connection with said lever.

21. The actuator according to claims 17, 18, 19 or 20 wherein said pin means delays the closing motion of said lever until the handle approaches the end of its closing motion.

* * * * *